United States Patent [19]

Holson

[11] 4,267,655

[45] May 19, 1981

[54] PRINT ALBUM

[75] Inventor: Sheldon Holson, Wilton, Conn.

[73] Assignee: The Holson Company, Wilton, Conn.

[21] Appl. No.: 30,327

[22] Filed: Apr. 16, 1979

[51] Int. Cl.[3] ..... G09G 1/10

[52] U.S. Cl. ..... 40/159; 40/405

[58] Field of Search ..... 40/405, 10 D, 159, 537

[56] References Cited

U.S. PATENT DOCUMENTS

| | | | |
|---|---|---|---|
| 683,853 | 10/1901 | Forbes | 40/537 |
| 2,610,421 | 9/1952 | Horn | 40/10 D |
| 2,775,050 | 12/1956 | Ellsworth | 40/159 |
| 2,986,144 | 5/1961 | Shepard | 40/159 |
| 3,797,152 | 3/1974 | Brandt | 40/159 |
| 3,921,322 | 11/1975 | Sharp | 40/405 |

*Primary Examiner*—Gene Mancene
*Assistant Examiner*—Wenceslao J. Contreras
*Attorney, Agent, or Firm*—Charles E. Temko

[57] ABSTRACT

A low cost photographic print album having a plurality of individual leaves affixed to the cover by gluing. Each leaf includes a paper filler member enclosed within a synthetic resinous envelope which forms an interstice on each side of the filler for the reception of a print. A pair of paper spacers is provided between the surfaces of the filler member and the envelope adjacent the edge of the leaf which is secured to a cover enclosing a plurality of leaves, so that as the album is filled with prints, the cover does not raise during the expansion of the leaves.

3 Claims, 4 Drawing Figures

PRINT ALBUM

BACKGROUND OF THE INVENTION

This invention relates generally to the field of photographic print albums, and more particularly to that form in which the individual leaves thereof are fabricated to each include a transparent envelope enclosing a paper filler, one edge of the leaf being secured to a binding which also secures front and rear covers. Inexpensive versions are often formed to overall length and width of a single print, and with a sufficient number of leaves to accommodate the prints resulting from the finishing of a single roll or cartridge of negative photographic film. Since such albums are usually given gratis to a customer without charge, the cost of fabrication must, of necessity, be low.

To this end, the leaves of the album, together with the front and rear covers are usually interconnected by a spirally configured wire which engages plural in-line openings in each leaf and cover member. As the album is filled, the leaves swell, and in most cases, no provision is incorporated to assure that the leaves and cover will remain in approximately mutually parallel relation. While the use of spacing members adjacent the bound edge in storage albums is known in the album and bookbinding art, such spacers do not present an attractive appearance, and add to the cost of fabrication, both in terms of material and labor. It is the usual practice to eliminate such structures with a corresponding loss of function in lower cost albums.

Because of the resultant thinness of the completed leaf, and the very thin gauge of the synthetic resinous envelope, attempts at gluing the leaves to a centrally disposed binding portion of a composite cover have not proven successful, and despite superior appearance, this type of construction in low cost albums has not found substantial commercial acceptance.

SUMMARY OF THE INVENTION

Briefly stated, the invention contemplates the provision of an improved low-cost photoprint album of the class described in which the above-mentioned disadvantages have been substantially eliminated. The novel structure comprises a unitary cover of heavy gauge paper including front and rear lamina, interconnected by a medially-disposed binding strip to which edges of the individual leaves are glued. The leaves include a paper lamina forming a filler, and a clear synthetic resinous envelope enclosing the filler and including first and second lamina, each interconnected along a free end edge to the other. The bound edges thereof and an area immediately adjacent thereto are glued to a spacer strip which in turn is glued to an edge surface of the filler, so as to form an interstice of substantial thickness on each side of the filler for the reception of a print. The complete leaf may be manufactured as an inline web operation to be severed from the web upon completion, and a desired plurality of such leaves are bound by gluing to the inner surface of the above-mentioned binding strip.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
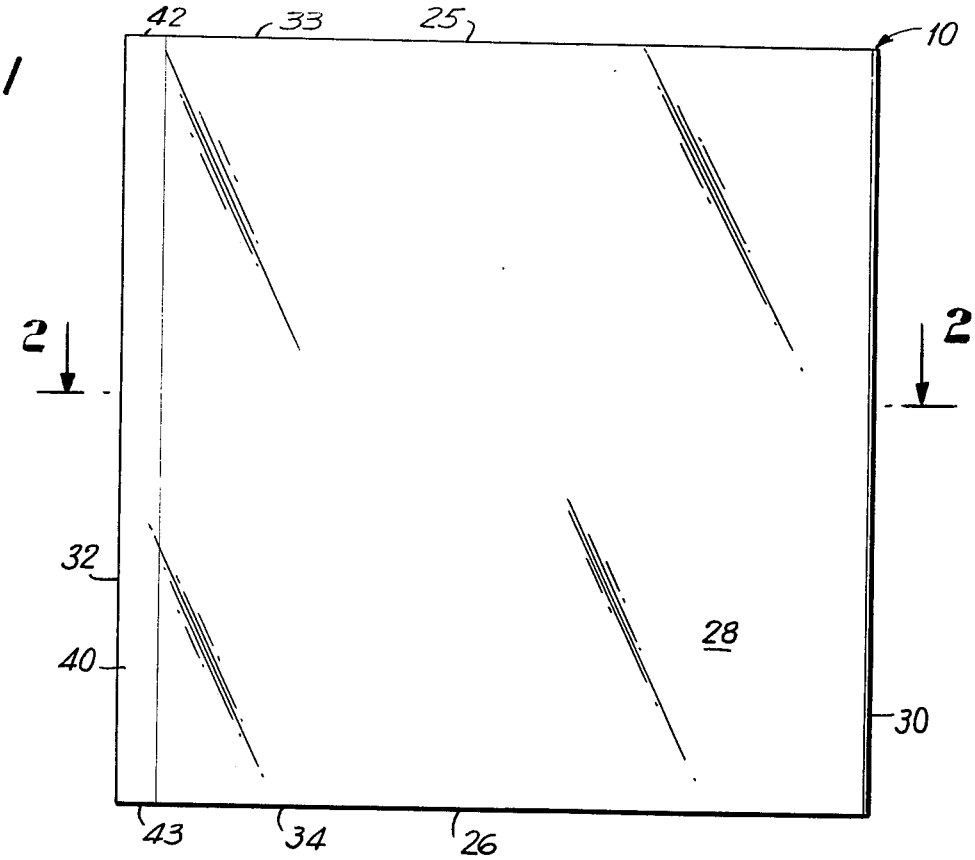
FIG. 1 is a side elevational view of an individual leaf forming part of a disclosed embodiment of the invention.
Figure 2:
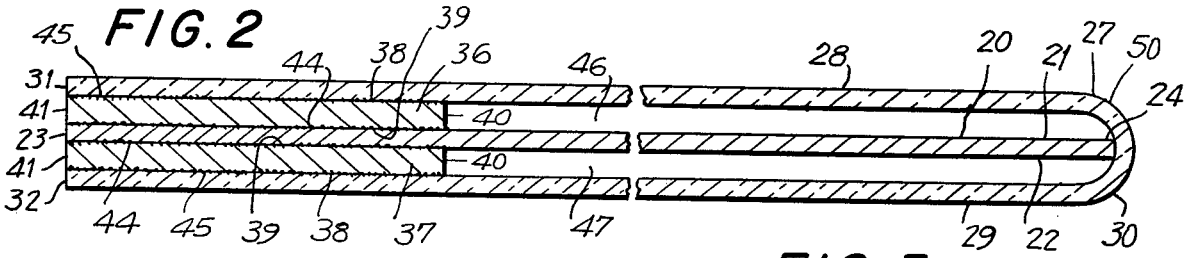
FIG. 2 is a longitudinal sectional view thereof, as seen from the plane 2—2 in FIG. 1.
Figure 3:
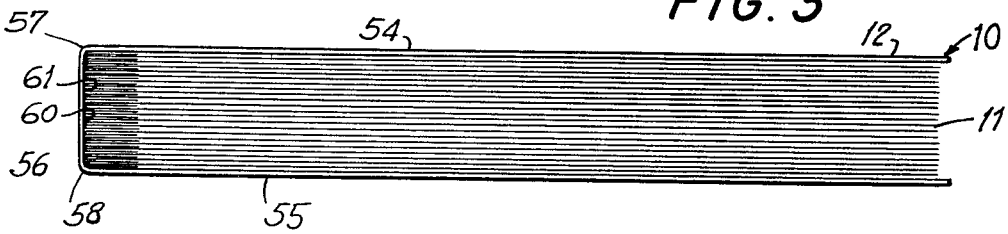
FIG. 3 is a top plan view of a completed album.

In accordance with the invention, the device, generally indicated by reference character 10, comprises broadly: a plurality of individual leaf or page elements 11 and a cover element 12.

The elements 11 are substantially similar, each including a rectangular opaque paper filler member 20 having first and second surfaces 21 and 22, respectively, and bounded by a bound end edge 23, a free end edge 24, and upper and lower edges 25 and 26, respectively. Surrounding the filler member is an envelope element 27 of synthetic resinous material, such as acetate or vinyl, the element 27 including first and second wall members 28 and 29, respectively.

The wall members 28 and 29 each include an interconnected edge 30, first and second bound edges 31 and 32, respectively, an upper edge 33, and a lower edge 34, in congruent relation with respect to the edges 25 and 26 of the element 11.

Positioned at the bound edges between the filler member 20 and the envelope element 27 are first and second elongated spacer members 36 and 37, respectively, each including first and second planar surfaces 38 and 39, elongated edges 40 and 41 and end edges 42 and 43. A first glue layer 44 interconnects the spacer members to the filler member 20, and a second glue layer 45 interconnects them to an adjacent wall of the envelope element 27. There is thus formed interstices 46 and 47 for the insertion of photographic prints (not shown) in well known manner. At the bound composite edge 50, the thickness of the assembled leaf element is approximately 0.19 inches, thus forming a relatively wide area for the affixation of the same by glue means to the cover element 12.

The cover element 12 is formed from a single piece of heavy paper, and includes a front or upper cover member 54, a rear or lower cover member 55, the members 54 and 55 being interconnected by a medially disposed binding strip 56 at fold lines 57 and 58. A glue layer 60 interconnects the inner surface 61 of the strip 56 with a plurality of juxtaposed pages 11 in a manner well known in the art.

Figure 4:
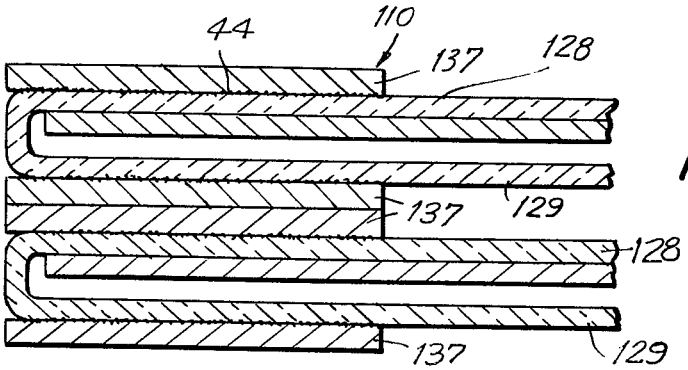
FIG. 4 is a plan view corresponding to that seen in FIG. 1, but showing an alternate form.

In the alternate form shown in FIG. 4, parts corresponding to those of the principal form have been designated with the same reference character, with the additional prefix "1". This form differs from the principal form only in the positioning of the spacer members 137 on outer surfaces of the envelope element 127, rather than the inner surfaces thereof, to provide an equivalent effect.

I wish it to be understood that I do not consider the invention limited to the precise details of structure shown and set forth in this specification, for obvious modifications will occur to those skilled in the art to which the invention pertains.

I claim:

1. A composite photo album page comprising: a generally rectangular planar opaque filler member and an envelope element of clear synthetic resinous material enclosing said filler member, said envelope including first and second laminae mutually interconnected along a first edge thereof, and having oppositely disposed edges in mutually spaced relation overlying a corresponding edge of said filler member, said filler member being interconnected to said envelope element only in the area adjacent said oppositely disposed edges; and at least one elongated spacer member positioned parallel to and adjacent to said corresponding edge, and glued to a surface of said envelope element; whereby upon the binding together of a plurality of pages to form an album, means is provided for the accommodation of the swelling of the pages upon the insertion of photographic prints within the interstices between said filler member and the inner surfaces of said first and second laminae, said interstices being accessable from side edges of said envelope element disposed between said first and said oppositely disposed edges.

2. A photo album page in accordance with claim 1, further characterized in said spacer member being glued to an inner surface of said envelope element, and a surface of said filler member.

3. A photo album page in accordance with claim 2, further comprising a second filler member glued to oppositely disposed surfaces of said envelope element and filler member.

* * * * *